United States Patent [19]

Sugiura

[11] Patent Number: 5,034,776

[45] Date of Patent: Jul. 23, 1991

[54] COPYING MACHINE AND TONER SUPPLY CONTAINER THEREFOR

[75] Inventor: Mitsushi Sugiura, Osaka, Japan

[73] Assignee: Minolta Camera Kabushiki Kaisha, Osaka, Japan

[21] Appl. No.: 312,136

[22] Filed: Feb. 17, 1989

[30] Foreign Application Priority Data

Feb. 19, 1988 [JP] Japan ..... 63-37999

[51] Int. Cl.[5] ..... G03G 15/06

[52] U.S. Cl. ..... 355/260; 222/DIG. 1

[58] Field of Search ..... 355/245, 246, 260, 253; 222/DIG. 1

[56] References Cited

U.S. PATENT DOCUMENTS 4,089,601 5/1978 Navone ..... 355/245

FOREIGN PATENT DOCUMENTS 59-195257 11/1984 Japan ..... 355/253

60-19173 1/1985 Japan ..... 355/245

60-59375 4/1985 Japan ..... 355/260

62-977 1/1987 Japan ..... 355/260

62-66284 3/1987 Japan .

63-244076 10/1988 Japan ..... 355/245

*Primary Examiner*—R. L. Moses

*Attorney, Agent, or Firm*—Willian Brinks Olds Hofer Gilson & Lione

[57] ABSTRACT

A copying machine of the present invention is constructed such that, when a toner in a toner containing portion provided in a developing unit is emptied, a toner supply container whose opening for supplying toner is sealed is mounted in the toner containing portion. An opening member for unsealing the opening for supplying the toner of the toner supply container is included in the toner containing portion, so that the toner can be replenished without staining the surroundings, and since the toner can be replenished only at frequencies restricted in advance, deterioration of copying quality can be avoided.

13 Claims, 6 Drawing Sheets

COPYING MACHINE AND TONER SUPPLY CONTAINER THEREFOR

BACKGROUND OF THE INVENTION

1. Field of the Invention

The present invention relates to an electrophotographic copying machine including a developing unit using a toner as a developer and toner supply container therefor.

2. Description of the Prior Art

A personal or domestic small-sized copying machine which is used relatively infrequently is popularized. As a method of supplying a toner to a developing unit installed in such a copying machine, for example, generally a used toner cartridge is removed from the developing unit and replaced with a new toner cartridge, or the toner is replenished to the removed toner cartridge. In recent years, taking a serious view on simple maintenance, a detachable replacement type developing unit has been developed in which a one-way developing unit is used and replaced with a new developing unit when the toner has to be replenished Now, when replacing the toner cartridge or replenishing only the toner, though it is advantageous in restraining the running cost, a problem is encountered in that the copying machine body, the developing unit or an operator's hands and clothes, and the like are stained with the toner scattered during operation.

Though it may be possible to increase the amount of toner to be charged to suppress the replenishing frequencies, the amount is limited due to enlargement of the machine size. Furthermore, in a two-component type developing unit, when only the toner is replenished for a long duration of use, the copying quality may be deteriorated due to wear and stain of a carrier.

In consideration of such circumstances, a system of restraining deterioration of the copying quality as well as avoiding stains due to the toner at replenishment by replacing the developing unit itself has been devised. However, in this system, since the entire developing unit has to be replaced when the toner is emptied, there is a problem that the cost for one copy or the copying cost is high.

SUMMARY OF THE INVENTION

The present invention has been devised in view of such circumstances, and therefore, it is a primary object thereof to provide a copying machine wherein surroundings are not contaminated when replenishing a toner.

It is another object of the present invention to provide a copying machine, wherein the deterioration of copying quality can be prevented by constructing the machine such that replenishment of the toner for a developing unit is limited to predetermined frequencies.

It is a further object of the present invention to provide a copying machine which is successful in reducing the copying cost.

It is still another object of the present invention to provide a toner supply container for use in the copying machine aforementioned.

The copying machine of the present invention is so constructed that, when the toner in a toner containing portion disposed in the developing unit is emptied, a toner supply container whose toner supply opening is sealed is mounted in the toner containing portion, in which is also provided an opening member for unsealing the toner supply opening of the toner supply container at this time. With such a construction, in the copying machine of the present invention, the toner can be supplied without staining the surroundings, and since the toner is supplied only at frequencies limited in advance, the deterioration of copying quality can be avoided.

The above and further objects and features of the invention will more fully be apparent from the following detailed description with accompanying drawings.

DESCRIPTION OF THE PREFERRED EMBODIMENTS

The present invention will be described specifically in reference to the accompanying drawings showing its embodiments as follows.

Figure 1:
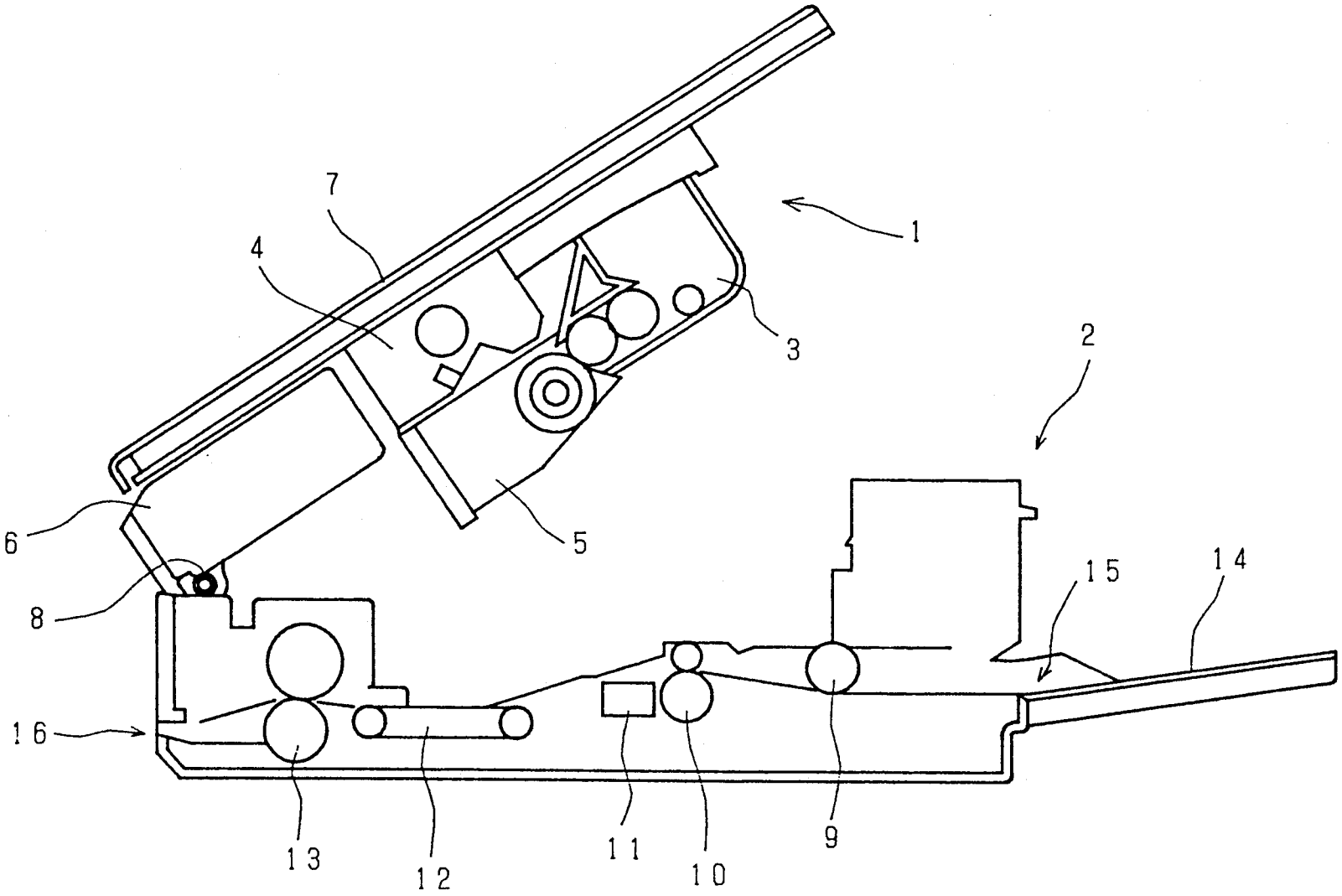
FIG. 1 is a schematic sectional elevation showing the internal construction of a copying machine of the present invention.

FIG. 1 is a schematic sectional elevation showing the internal construction of a copying machine according to the present invention.

As shown in FIG. 1, the copying machine of the present invention has a clam-shell construction in which an upper unit 1 can be opened with respect to a lower unit 2 about a pivot 8 shown in the left-hand side of the figure.

On the upper surface of the upper unit 1, a movable document table 7 which moves in both directions thereof in the figure is provided, and an optical and illuminating system unit 4, a developing unit 3 and an exhaust fan 6 are disposed generally in the center, on the right-hand side and on the left-hand side, respectively, thereunder. Under the optical and illuminating system unit 4, a photoreceptor unit 5 comprising a photosensitive drum, a charger, a cleaning unit and the like is installed.

On the right-hand side of the lower unit 2, a feed paper inlet 15 mounted with a paper feed tray 14 is provided. In the vicinity inside the paper feed inlet 15, a paper feed roller 9 is arranged, and in the center located underneath the photoreceptor unit 5, a timing roller 10 and a transfer charger 11 are disposed. On the left-hand side of the transfer charger 11, a transporting belt 12 is provided, and on the left-hand side thereof, a fixing unit 13 and a discharge paper outlet 16 are provided.

Copying operation of the copying machine of the present invention thus constructed is basically as same as that of the conventional general copying machine.

That is, a document placed on the document table 7 is scanned by the optical and illuminating system unit 4 by movement of the document table 7, thereby forming an electrostatic latent image corresponding to a document image on the photosensitive drum of the photoreceptor unit 5. Then, a toner is stuck to the photosensitive drum by the developing unit 3 and the electrostatic latent image is developed into a toner image.

Meanwhile, a copy paper is transported by the paper feed roller 9 from the paper feed tray 14 and stopped temporarily by the timing roller 10. Then, in synchronism with the rotating timing of the photosensitive drum, the copy paper is fed between the photosensitive drum, and the transfer charger 11 and the toner image is transferred thereon. The copy paper onto which the toner image is transferred is transported by the transport belt 12 to the fixing unit 13, wherein the toner image is fused and fixed by heating, and discharged from the discharge paper outlet 16.

Figure 2:
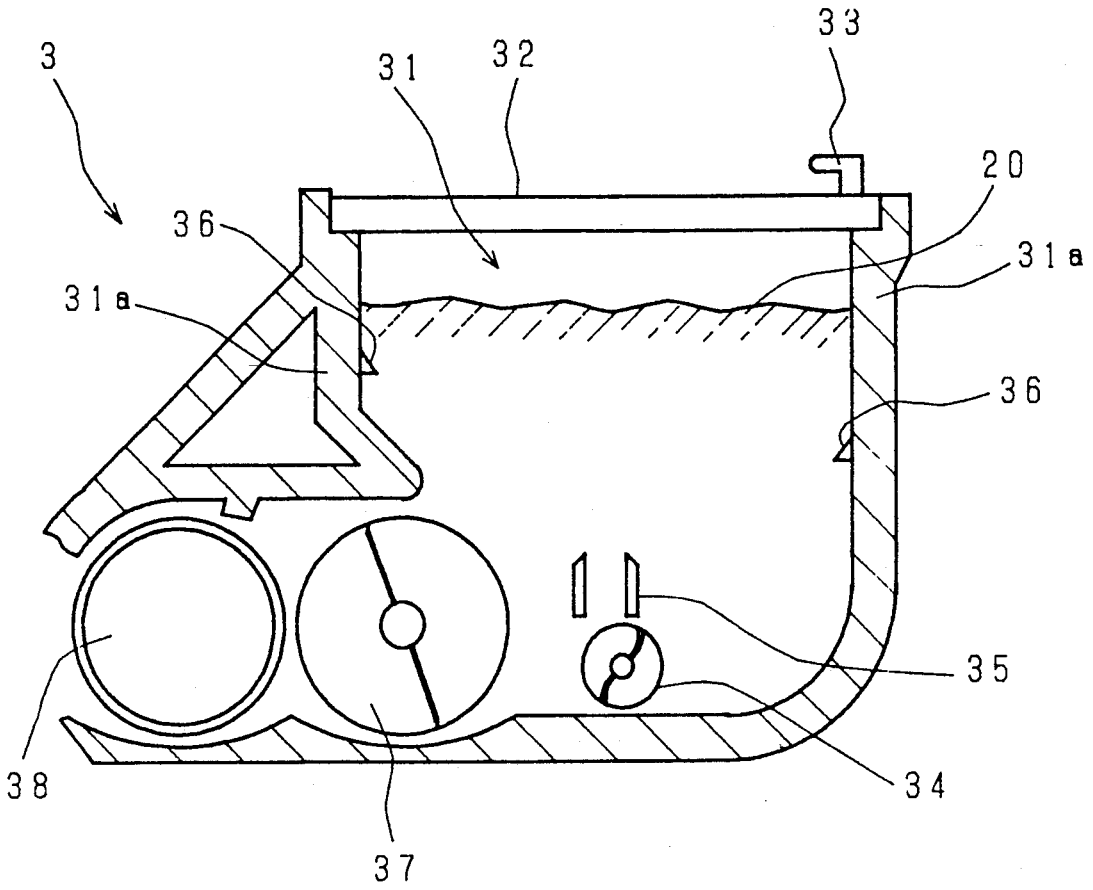
FIG. 2 is a detailed sectional elevation of a developing unit.

FIG. 2 is a sectional elevation of the developing unit 3 in the copying machine of the present invention.

As shown in FIG. 1, the developing unit 3 is so constructed that it is detachable from the upper unit 1 by opening the upper unit 1. The developing unit 3 includes a toner containing portion 31 containing a toner 20 at its right-hand portion of the figure.

In the bottom of the toner containing portion 31, there are provided a stirring vane 34 and a larger stirring vane 37 on its left-hand side or on the side of the photosensitive drum 5. On the left-hand side of the stirring vane 37, a developing sleeve 38 is arranged, and on the left side thereof, an opening opposing the photoreceptor unit 5 is formed.

Thus, the toner 20 is charged by mixing with the carrier by the stirring vanes 34 and 37, and transferred to the developing sleeve 38 together with the carrier. Then, it is supplied to the photoreceptor unit 5 by the rotation of the sleeve 38.

Figure 3:
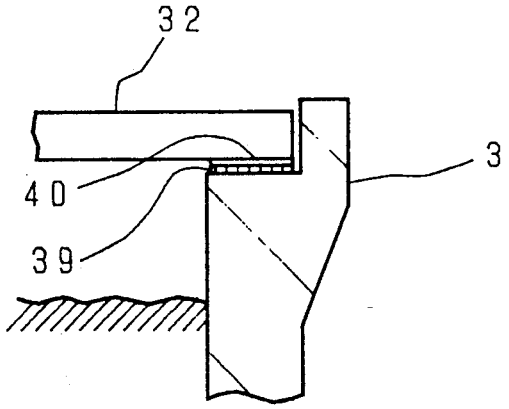
FIG. 3 is an enlarged fragmentary sectional elevation of the developing unit shown in FIG. 2.

On the toner containing portion 31, a cover 32 with a grip 33 is provided. As shown in an enlarged fragmentary sectional elevation of FIG. 3, the cover 32 is stuck to the upper end portion of the toner containing portion 31 via a board 40 by a double coated adhesive tape 39. The board 40 is stuck unremovably to the cover 32, thus when the cover 32 is removed from the containing portion 31, it is separated between the board 40 and the double coated adhesive tape 39.

The adhesive force between the double coated adhesive tape 39 and the board 40 is made sufficient such that the cover 32 is not removed in normal use.

On side walls 31*a* opposing each other in both directions in the figure in the toner containing portion 31, projections 36 directing downward are provided, respectively. Substantially right above the stirring vane 34, a pair of blades 35 spaced and opposing each other with the respective blade tips directed upwardly are disposed.

Figure 4:
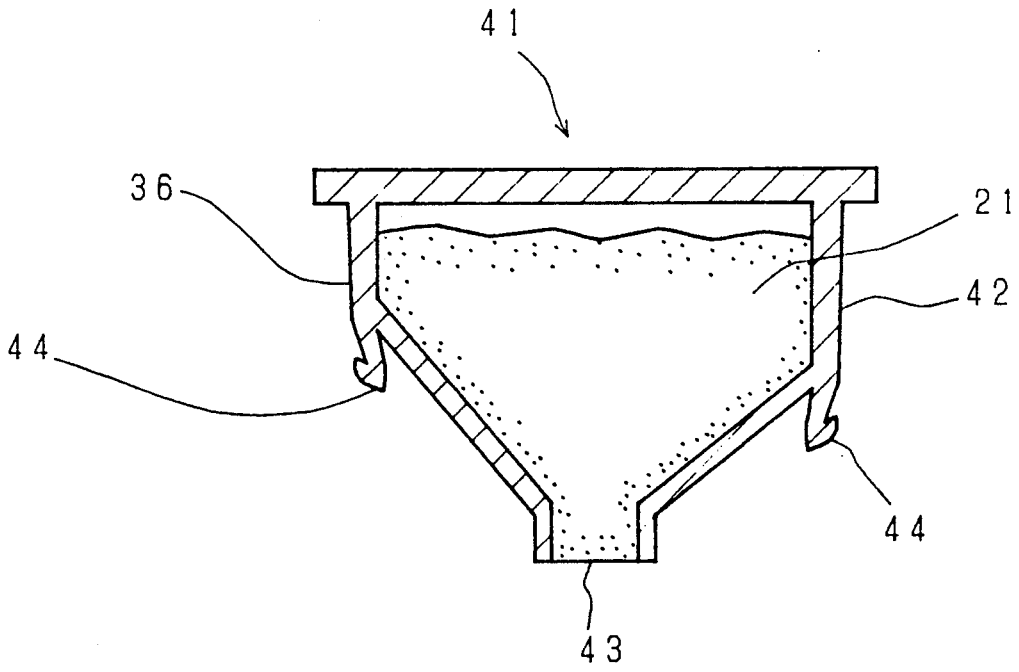
FIG. 4 is a sectional elevation showing the configuration of a toner container.

FIG. 4 is a sectional elevation of a toner box which is a toner supply container.

The toner box 41 contains the replenishing toner 21 therein and is shaped to fit into the toner containing portion 31 of the developing unit 3. The bottom portion of the toner box 41 is formed into a funnel shape by bending the lower portion of two side walls 42 at vertical intermediate portions in the direction approaching one another. An opening for supplying the toner closed by a seal 43 is provided on the tip of the funnel.

Under respective bent portions of the side walls 42, claws 44 having a suitable resilience are disposed. The claws 44, as to be described later, serve as lock means for mounting the toner box 41 to the toner containing portion 31, by engaging the projections 36, 36 provided on the side walls 31*a* opposing with each other in the toner containing portion 31.

The upper portion of the toner box 41 has substantially the same shape and size as the cover 32 of the developing unit 3, and is formed as a flange on the upper ends of four side walls including the side walls 42.

Now, operating procedures for supplying the toner in the developing unit 3 and the toner box 41 thus constructed will be described as follows.

Figure 5:
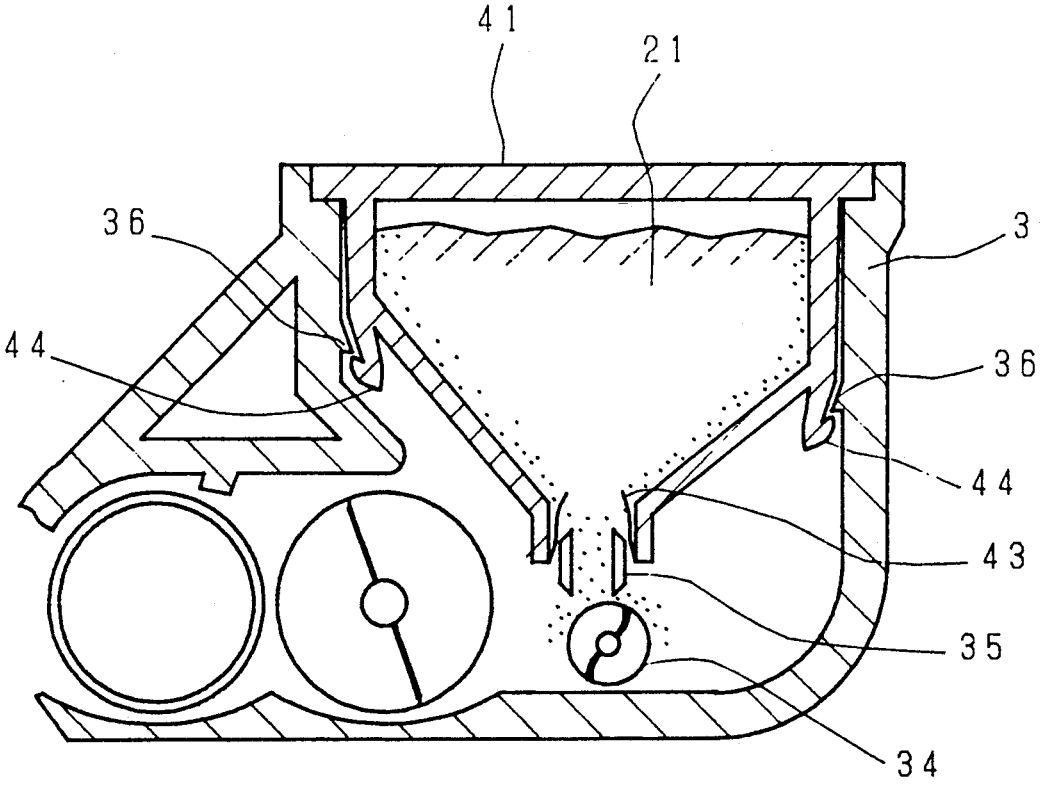
FIG. 5 is a sectional elevation showing a state of mounting a toner supply container to the developing unit.

When the toner 20 is used and reduced, first the developing unit 3 is removed from the upper unit 1 for replenishing the toner 20. Then, the cover 32 of the toner containing portion 31 is removed by holding the grip 33, and as shown in a sectional elevation of FIG. 5, the toner box 41 is inserted into the toner containing portion 31. Thereby, the bottom seal 43 of the toner box 41 is adapted to be opened by the blades 35 provided in the containing portion, discharging the toner 21 to the containing portion 31 from the bottom opening of the toner box 41.

At the same time, the claws 44 of the toner box 41 engage the projections 36 provided in the toner containing portion 31 such that the toner box 41 can not be removed from the developing unit 3.

Since the upper end portion of the toner containing portion 31 is stuck to the upper flange portion of the toner box 41 by the double coated adhesive tape 39, its upper end opening is sealed to prevent the discharged toner 21 from scattering to the outside.

As described above, one toner box 41 is adapted to supply the toner just once to the developing unit 3. As a result, as compared with the developing unit which has been thrown away hitherto without replenishing the toner even once, the developing unit of the present invention permits copying approximately twice as much.

Figure 6:
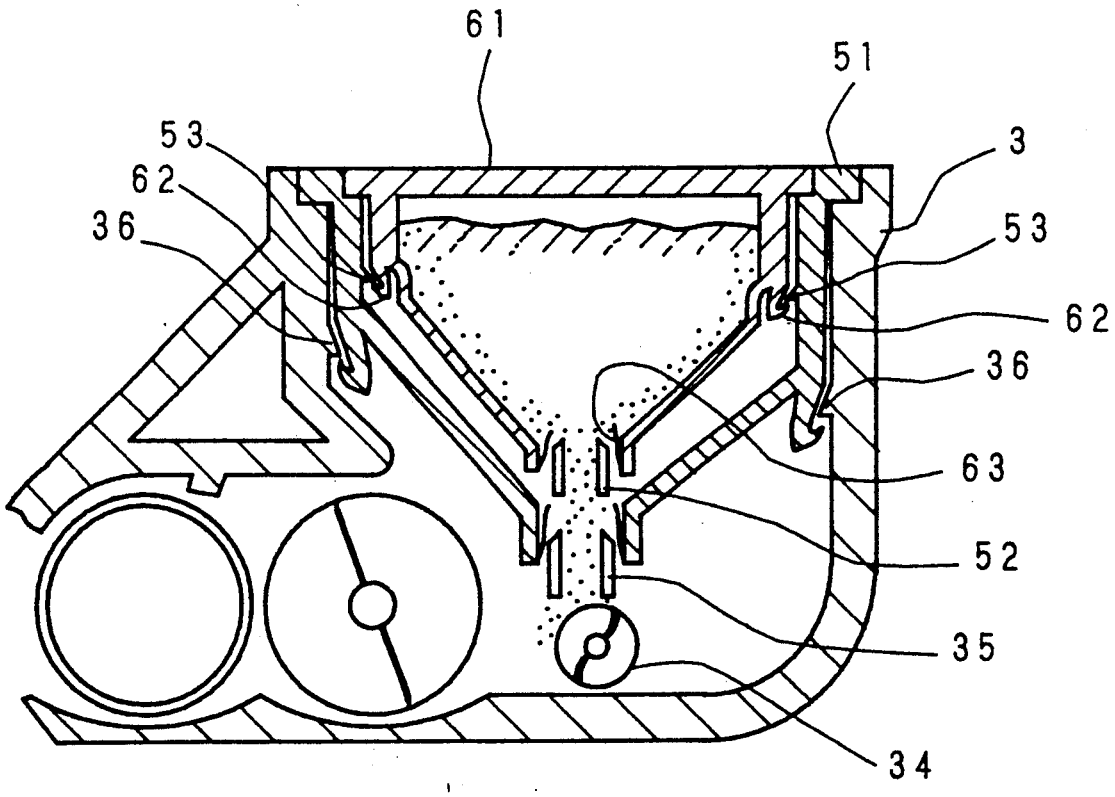
FIG. 6 is a sectional elevation of a developing unit showing a state of mounting a toner supply container of another embodiment of the invention into a toner containing portion.

FIG. 6 is a sectional elevation showing a state of mounting a toner box to the developing unit 3 for enabling replenishment of the toner twice or more.

The same as the toner box 41 aforementioned, a toner box 51 inserted unmovably into the containing portion 31 of the developing unit 3 is provided with blades 52 and projections 53 having the same shapes as the respective blades 35 and projections 36 of the containing portion 31, respectively near the bottom and on opposing side walls inside thereof. Though a cover the same as the cover 32 of the toner containing portion 31 is fixed to the upper portion of the toner box 51 with a double coated adhesive tape (not shown), FIG. 6 shows the state that the cover is removed since the toner in the toner box 51 was emptied and the toner has to be replenished from the toner box 61.

The toner box 61 is formed into the same shape as the toner box 51 but in a smaller size, and includes a seal 63 which is opened by the blades 52 and claws 62 which engage the projections 53 when inserted into the toner box 51.

Thus, by inserting the toner box 61 into the toner box 51, the toner for replenishment contained therein is discharged to the toner containing portion 31 of the developing unit 3, and, at the same time, the toner box 61 becomes impossible to be removed from the toner box 51 or, in other words, from the containing portion 31, and the upper end portion of the toner box 51 is sealed with that of the toner box 61 by the double coated adhesive tape.

As described hereinabove, it is also possible to provide the same blades and projections in the toner box 61 and a cover thereon to insert a further smaller toner box into the toner box 51 and to replenish the toner.

Figure 7:
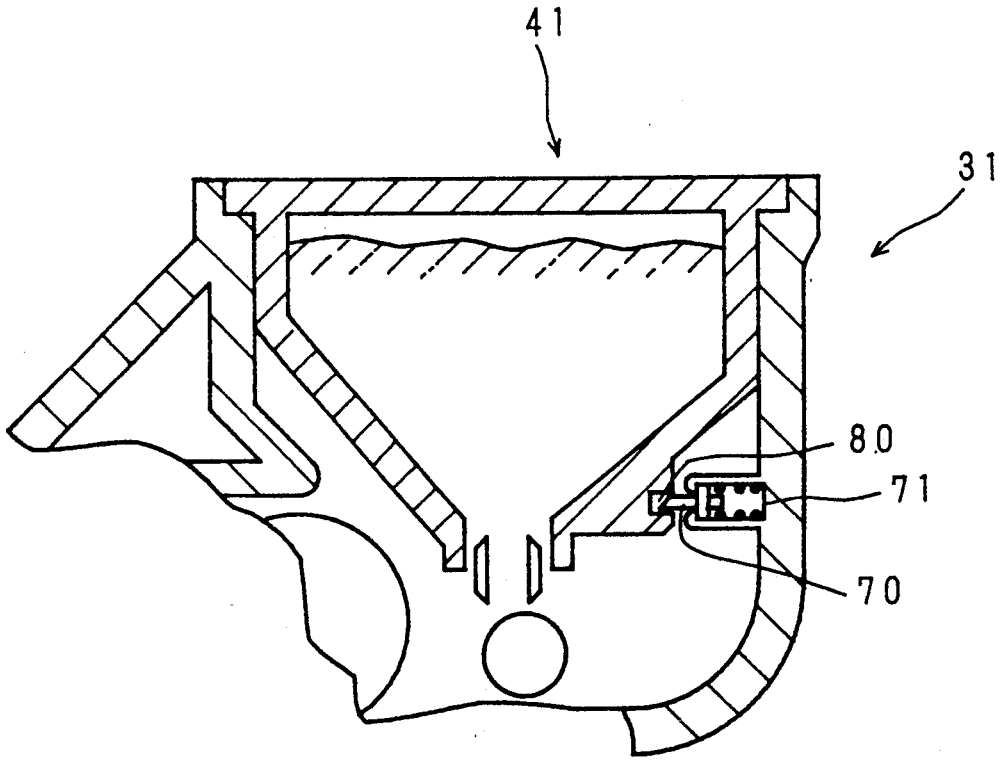
FIG. 7 is a sectional elevation of an essential portion of a developing unit and a toner supply container showing another embodiment of the invention.

In the aforesaid two embodiments, though the combination of projections and claws are used as lock means for making removal of the toner box 41 (or 61) from the toner containing portion 31 (or the toner box 41 of a size larger) impossible, in lieu of this, as shown in FIG. 7, the combination of a pin 70 which is provided on the side of the toner containing portion 31 (or the toner box 41) and forcibly supported axially by a spring 71, and a depression 80 which is formed in the toner box 41 (or the toner box 61) and to which the pin 70 is engaged may also be used.

The adhesive width of the double coated adhesive tape for sealing toner containing portion 31 (or the toner box 41) at the upper end portion of the toner box 41 (or the toner box 61) may be wide enough to make removal impossible by its adhesive force only.

Furthermore, in the present embodiments, the developing unit is detachable independently with respect to the body of the copying machine. However, the present invention is not limited thereto. For example, it may also be applied in a so-called process kit in which the developing unit and the photoreceptor unit are detachable in a body. In this case, waste of replacing the entire process kit corresponding to the consumption of the toner, even when component parts such as the photoreceptor and the like. are still usable as in the past, can be eliminated, resulting in reducing the copying cost.

As described hereinabove in detail, in a copying machine of the present invention, since a toner supply container is sealed immediately when mounted to a developing unit and can not be removed again, stains caused by scattering of the toner which occurred when removing and replacing an emptied toner cartridge in a conventional copying machine can be minimized. Also, replenishing frequencies are not unlimited as in the past but restricted, so that the toner becomes impossible to be supplied to the developing unit prior to the occurrence of wear and stain of the carrier, thus the deterioration of copying quality can be prevented reliably.

Furthermore, when compared to the prior art one-way type developing unit, since the toner quantity can be increased in the present copying machine, the copying cost can be considerably reduced.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the metes and bounds of the claims, or equivalence of such metes and bounds thereof are therefore intended to be embraced by the claims.

What is claimed is:

1. A copying machine comprising a developing unit having a toner containing portion which initially contains a supply of toner, wherein said toner containing portion comprises an opening which can be closed and having a size into which a toner supply container containing toner therein can be mounted when said supply of toner initially contained in said toner containing portion is substantially consumed, and a lock means for fixing said toner supply container on the inner surface of said toner containing portion when said toner supply container is mounted.

2. A copying machine as set forth in claim 1, wherein said toner supply container is mounted into said toner containing portion by being inserted thereinto.

3. A copying machine as set forth in claim 1, wherein said toner containing portion comprises a breaking member for breaking said toner supply container when said toner supply container is mounted.

4. A copying machine comprising a developing unit having a toner containing portion, wherein said toner containing portion comprises a first opening which can be closed and having a size into which a first toner supply container containing toner therein can be mounted, said first toner supply container comprising a second opening which can be closed and having a size into which a second toner supply container containing toner therein can be mounted, a first lock means for fixing said first toner supply container on the inner surface of said toner containing portion when said first toner supply container is mounted, and a second lock means for fixing said second toner supply container on the inner surface of said first toner supply container when said second toner supply container is mounted.

5. A copying machine as set forth in claim 4, wherein said second toner supply container is mounted into said first toner supply container by being inserted thereinto.

6. A copying machine as set forth in claim 4, wherein said first toner supply container comprises a breaking member for breaking said second toner supply container when said second toner supply container is mounted.

7. A toner supply container for a copying machine comprising a lock means for being fixed into a toner containing portion provided in a developing unit of said copying machine when being mounted, said toner containing portion initially containing a supply of toner, and a breakable part through which toner is supplied into said toner containing portion and which is broken when being mounted into said toner containing portion, whereby said breakable part is adapted to be broken by a breaking member disposed in said toner containing portion when being mounted in said toner containing portion, said toner supply container being mounted in said toner containing portion when said supply of toner initially contained in said toner containing portion is substantially consumed.

8. A toner supply container for a copying machine as set forth in claim 7, wherein said breakable part is an opening and is sealed by a sealing member.

9. A toner supply container for a copying machine as set forth in claim 7, wherein said toner supply container is mounted into said toner containing portion by being inserted thereinto.

10. A toner supply container for a copying machine comprising an opening which can be closed and having a size into which an other toner supply container containing toner can be mounted, a lock means for being fixed into a toner containing portion provided in a developing unit of said copying machine when being mounted, a fixing means for fixing said other toner supply container on the inner surface thereof when said other toner supply container is mounted, a breakable part through which toner is supplied into said toner containing portion and which is broken when being mounted into said toner containing portion, and a breaking member for breaking said other toner supply container when said other toner supply container is mounted.

11. A toner supply container for a copying machine as set forth in claim 10, wherein said breakable part is an opening and is sealed by a sealing member.

12. A toner supply container for a copying machine as set forth in claim 10, wherein said other toner supply container is mounted into said toner supply container by being inserted thereinto.

13. An image forming apparatus comprising:

an electrostatic latent image supporting member;

a developing means for developing an electrostatic latent image supported on said electrostatic latent image supporting member;

a first developer container for supplying developer to the developing means; and a second developer container for supplying the developer to the developing means, said second developer container being mountable in the first developer container in place of the developer accommodated in the first developer container.

* * * * *

UNITED STATES PATENT AND TRADEMARK OFFICE

CERTIFICATE OF CORRECTION

PATENT NO. : 5,034,776

DATED : July 23, 1991

INVENTOR(S) : Mitsushi Sugiura

It is certified that error appears in the above-identified patent and that said Letters Patent is hereby corrected as shown below:

In col. 1, line 29, after "during", insert --the--.

In col. 3, line 17, after "drum", delete "," (comma).

In col. 5, line 35, after "like", delete "." (period).

In col. 5, line 35, after "usable", insert "," (comma).

Signed and Sealed this

Twelfth Day of January, 1993

*Attest:*

*Attesting Officer*

DOUGLAS B. COMER

*Acting Commissioner of Patents and Trademarks*